United States Patent [19]

Mobley

[11] Patent Number: 4,880,113

[45] **Date of Patent: * Nov. 14, 1989**

[54] TROLLEY WITH HANGER RETAINING STRUCTURE WHICH INHIBITS UNINTENDED HANGER WITHDRAWAL

[75] Inventor: Lawrence R. Mobley, Aurora, Colo.

[73] Assignee: Samsonite Corporation, Denver, Colo.

[ * ] Notice: The portion of the term of this patent subsequent to Jan. 17, 2006 has been disclaimed.

[21] Appl. No.: 229,018

[22] Filed: Aug. 5, 1988

Related U.S. Application Data

[63] Continuation of Ser. No. 917,409, Oct. 10, 1986, Pat. No. 4,798,289, which is a continuation-in-part of Ser. No. 754,617, Jul. 12, 1985, Pat. No. 4,640,414, which is a continuation-in-part of Ser. No. 673,353, Nov. 23, 1984, Pat. No. 4,618,058.

[51] Int. Cl.[4] ..... B65D 85/18

[52] U.S. Cl. ..... 206/287; 24/516; 206/279; 206/285; 206/291; 206/293; 248/316.7; 248/316.6; 294/163

[58] Field of Search ..... 206/279, 287, 287.1, 206/291, 284, 285, 289, 293; 24/515, 516, 517, 535, 241 PS, 536; 248/316.1–316.8, 340; 294/143, 163

[56] References Cited

U.S. PATENT DOCUMENTS

| | | | |
|---|---|---|---|
| D. 294,004 | 2/1988 | Mobley et al. | D8/330 |
| D. 294,451 | 3/1988 | Gregg et al. | D8/330 |
| D. 294,674 | 3/1988 | Mobley et al. | D8/330 |
| 3,566,456 | 3/1971 | London | 206/279 |
| 4,252,220 | 2/1981 | London et al. | 206/285 X |
| 4,266,705 | 5/1981 | Wheeler | 294/163 |
| 4,363,388 | 12/1982 | London et al. | 206/287 X |
| 4,557,516 | 12/1985 | Usner | 294/143 |
| 4,618,058 | 10/1986 | Gregg et al. | 206/291 |
| 4,640,414 | 2/1987 | Mobley et al. | 206/287 |
| 4,798,289 | 1/1989 | Mobley | 206/287 |

*Primary Examiner*—Bryon P. Gehman
*Attorney, Agent, or Firm*—John R. Ley

[57] ABSTRACT

A trolley for suspending and retaining the hooked ends of clothes hangers in a piece of luggage such as a garment bag includes gripping structures which contact the hooked ends of the hangers. The gripping structures incorporate an arrangement for creating a greater resistance against withdrawing the hanger ends from between the opposed gripping structures than for moving the hanger ends into the trolley. The effect is preferably established by a rib configuration integral with the gripping structures that creates a pawl-like resistance. The pawl-like resistance retains the hanger ends in the trolley and inhibits them from unintentional withdrawal from the trolley.

4 Claims, 2 Drawing Sheets

TROLLEY WITH HANGER RETAINING STRUCTURE WHICH INHIBITS UNINTENDED HANGER WITHDRAWAL

CROSS-REFERENCE TO RELATED APPLICATIONS

The present application is a continuation of the U.S. patent application Ser. No. 917,409 filed Oct. 10, 1986, now U.S. Pat. No. 4,798,289 for a "Trolley With Hanger Retaining Pads Which Inhibit Unintended Hanger Withdrawal". That application was a continuation in part of U.S. patent application Ser. No. 754,617 filed July 12, 1985, now U.S. Pat. No. 4,690,414 for a "Locking Trolley for Garment Bag With Improved Hanger Retention", and that application is a continuation in part of U.S. patent application Ser. No. 673,353 filed Nov. 23, 1984, now U.S. Pat. No. 4,618,058 for a "Locking Trolley". Each of these prior applications has been assigned to the assignee of the present invention. The subject matter of each of these prior applications is incorporated in this application by this reference.

The present invention relates to a new and improved trolley which retains the hooked ends of hangers in a piece of luggage, particularly a garment bag. More specifically, the improvements of the present invention relate to an improvement, preferably incorporated in the resilient flexible gripping pad members of the trolley, which inhibits the unintended withdrawal of the hanger ends from the trolley, thereby more positively retaining the hangers on the trolley.

BACKGROUND OF THE INVENTION

The primary purpose of a trolley is to hold the hangers and the clothes on the hangers in position when traveling with the garment bag. By retaining the hanger, the clothes attached to the hanger will not dislodge and accumulate in bunches that might create wrinkles in the clothes.

The trolley must also have the capability to release the hangers so that the clothes can be removed from the garment bag and the clothes can be added when packing the garment bag. The ability to conveniently add and remove the hangers from the trolley when the garment bag is not in use is an important matter of convenience for the user.

The two primary purposes of a trolley, i.e. firmly retaining the hangers when traveling and providing access for removing and adding the hangers when packing the garment bag, have been accomplished by various prior trolleys. The present invention relates to further improvements in the field of trolleys.

SUMMARY OF THE INVENTION

The present invention further improves on the ability of retaining the hooked ends of hangers against unintentional withdrawal when the trolley is in use, and also provides an improved capability for adding hangers while packing the garment bag.

In accordance with certain of its significant aspects, the trolley of the present invention comprises a substantially rigid frame member which defines an opening extending into the frame member from a front location, a gripping structures which is preferably formed of a pair of resilient flexible material which are operatively connected to the frame member within the opening in an opposite facing relationship and between which the hooked ends of the hangers are inserted and removed from the front location. The improvement of the present invention includes means associated with the gripping structure for creating a resistance to the removal of the hanger ends which is greater when moving the hanger ends toward the front location than when moving the hanger ends into the opening from the front location. Preferably the greater resistance for moving the hanger ends out of the opening is a result of the resiliency of the gripping structures and a plurality of ribs of resilient flexible material which converge toward the opposite gripping structure and away from the front location toward the rear of the opening. The convergance of the ribs creates a pawl-like or detent-like resistance effect in the gripping structure to create a greater resistance on the hanger ends as they attempt to move toward the front location, as compared to resistance to the movement of the hanger ends in an opposite direction toward the rear of the opening.

The invention can be more completely understood by reference to the following description of the presently preferred embodiment taken in conjunction with the drawings. Of course, the invention itself is defined by the scope of the appended claims.

DESCRIPTION OF PREFERRED EMBODIMENT

Figure 1:
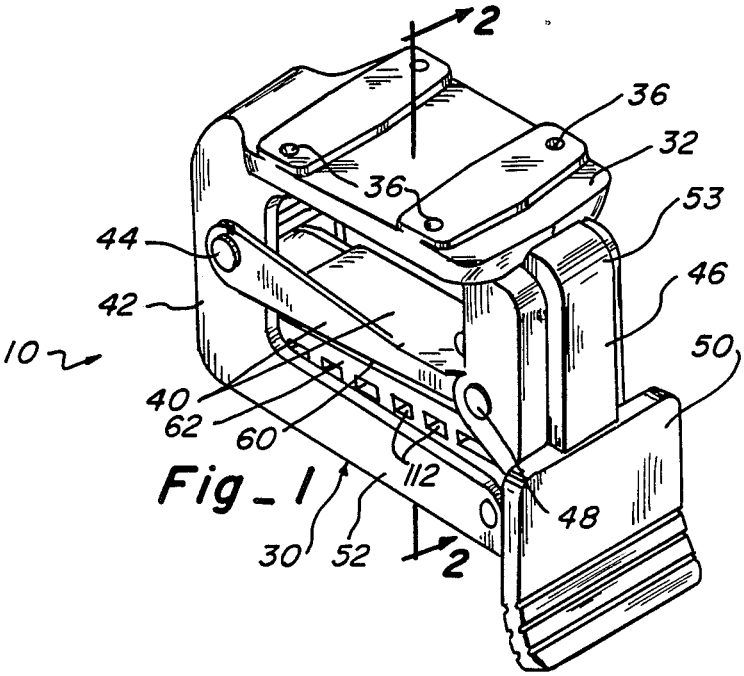
FIG. 1 is a perspective view of a trolley of the present invention.
Figure 2:
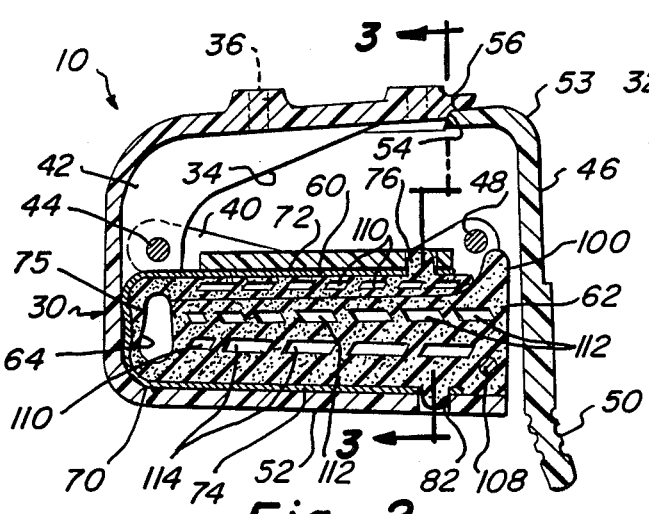
FIG. 2 is a section view of FIG. 1, taken substantially in the plane of line 2—2.
Figure 3:
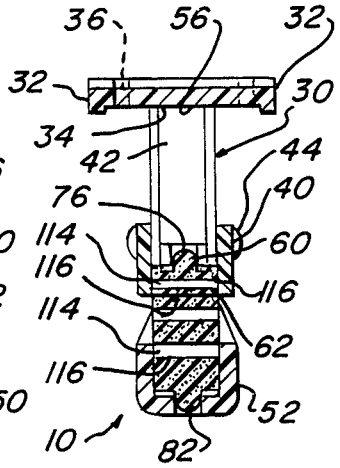
FIG. 3 is a section view of FIG. 2, taken substantially in the plane of line 3—3.

Details of a trolley 10 are better understood by reference to FIGS. 1, 2 and 3. The trolley 10 will be described and claimed in relation to the orientation shown in FIGS. 2 and 3. The trolley 10 includes a C-shaped main frame member 30. A pair of flanges 32 extend transversely outward on opposite sides of an upper horizontal portion 34 of the C-shaped frame member 30. Holes 36 are formed through each of the flanges 34 for the purpose of receiving rivets or other fasteners (not shown) to attach the trolley 10 to the interior surface of the top side gusset of a garment bag (not shown).

A clamping jaw member 40 is pivotably connected to a rear vertical portion 42 of the C-shaped frame member 30 by a pin 44. The clamping jaw member 40 extends forwardly to a front end where a locking lever 46 is operatively connected to the frame member 30 by a pivotable connection to the jaw member 40 by another pin 48. The locking lever 46 includes a finger grasping portion 50 which extends below a bottom horizontal portion 52 of the C-shaped frame member 30 when in the locked position shown in FIGS. 2 and 5. An upper surface portion 53 of the locking lever 46 curves upwardly and rearwardly and terminates at a perpendicular locking edge structure 54. The locking edge 54 abuts a transversely extending locking shoulder structure 56 in the locked position. The lcoking shoulder 56 is formed in the forward inside edge of the upper horizontal leg portion 34 of the frame member.

A gripping structure in the form of pads 60 and 62 are located in an opposite facing relationship in the trolley 10 within an opening generally defined by the C-shaped frame member. The gripping pads 60 and 62 are connected to the frame member, preferably by means of the following described arrangement, but other connection arrangements are also contemplated.

Figure 5:
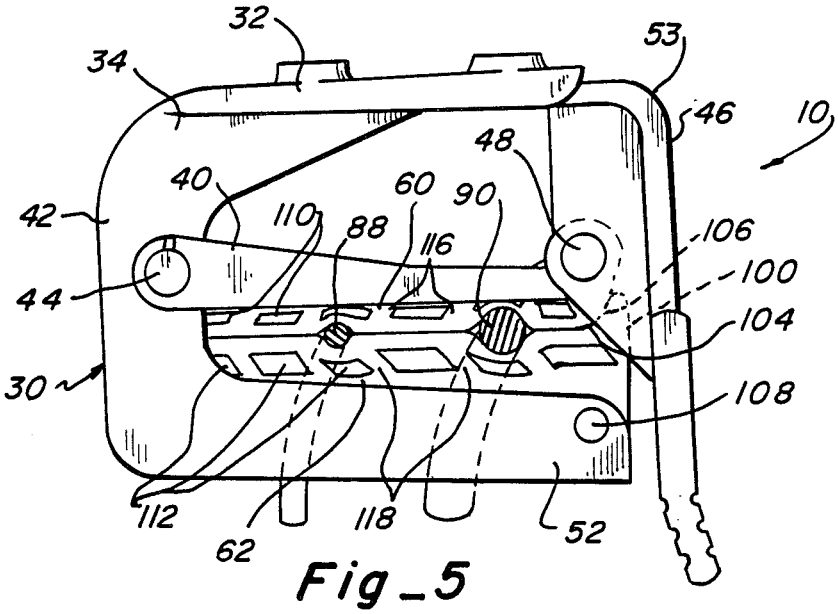
FIG. 5 is an enlarged side elevational view of the trolley similar to FIG. 4 but illustrated in its locked position, and further showing two ends of clothes hangers retained in the trolley, and the pawl-like resistance effect created by the improvement of the present invention.

The upper gripping pad 60 is received within a U-shaped channel of the clamping jaw member 40, as is illustrated in FIG. 3. The cross sectional configuration of the bottom horizontal leg portion 52 of the C-shaped frame 30 also defines a U-shaped channel as is illustrated in FIG. 3, and the bottom gripping pad 62 is seated within this U-shaped channel. Both gripping pads 60 and 62 are connected by a thin web 64 of material adjacent the rear vertical portion 52 of the C-shaped frame member 30. The gripping pads 60 and 62 and the web 64 are formed of flexible and resilient material, such as rubber, flexible plastic or the like. The flexibility of this material allows it to conform around the cross sectional configuration of a variety of different sizes and shapes of hook shaped end portions of hangers, as is illustrated in FIG. 5. This compressibility of the material is increased by forming voids or holes 110, 112 and 114 in the pads 60 and 62, the axes of which are oriented generally parallel to the axis of the pin 44 and tranversely to the length of the pads 60 and 62.

Figure 4:
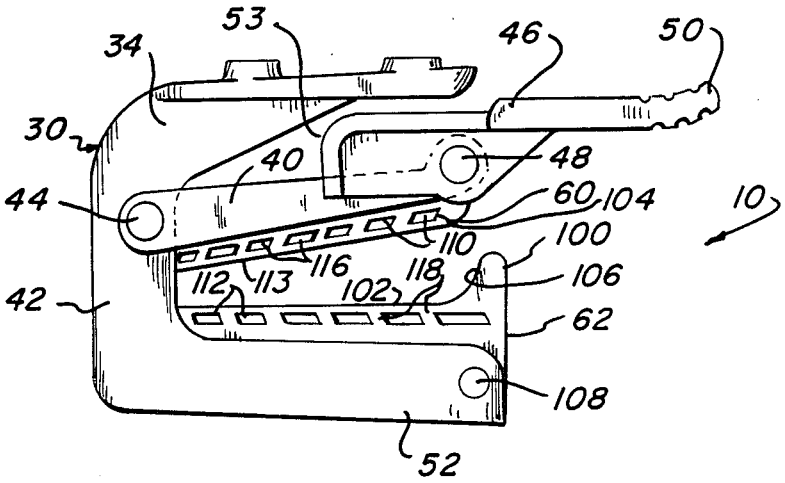
FIG. 4 is a side elevational view of the trolley shown in FIG. 2, illustrating its unlocked position.

An elongated U-shaped spring strip 70 also fits within the opposed facing U-shaped channels of the clamping jaw member 40 and the bottom horizontal portion 52. The spring strip 70 is formed of spring metal and is biased to pivot the jaw member 40 counterclockwise with respect to the bottom horizontal portion 52 and toward the upper horizontal portion 34, as shown in FIG. 4. A flat forward projecting upper leg portion 72 of the spring strip 70 fits between the upper gripping pad 60 and the flat interior wall of the U-shaped channel of the jaw member 40. Similarly, a flat forward projecting lower leg portion 74 of the spring strip 70 fits between the lower gripping pad 62 and the interior flat wall of the U-shaped channel of the bottom horizontal portion 52. A curved portion 75 of the spring strip joins the two leg portions 72 and 74 and is positioned adjacent the rear vertical portion 42 of the frame member 30. A projection 76 extends upward from the gripping pad 60 through aligned holes in the leg portion 72 of the spring strip 70 and in the bottom wall of the channel of the jaw member 40. Similarly, a projection 82 extends downward from the gripping pad 62 through aligned holes in the leg portion 74 of the spring strip 70 and in the inner wall of the U-shaped channel of the lower leg portion 42 of the C-shaped member 30. The friction fit between the projections 76 and 82 and their aligned holes operatively holds or retains the spring strip 70 and the gripping pads 60 and 62 between the lower horizontal leg portion 52 and the jaw member 40 and within their U-shaped channels.

In an alternative pad retaining and connecting arrangement, the projections 76 and 82 can be formed within enlarged heads, such that the heads are slightly larger than the holes in the leg portions 72 and 74 of the spring strip 70. Such heads are then compressed to pass through the aligned holes in the spring strip and in the jaw member 40 and lower horizontal leg portion 52 and, upon expanding, retain the gripping pads 60 and 62 in position. The holes in the spring strip 70 may be formed by punching a forward opening C-shaped slot (not shown) into the spring strip, and then bending the tabs (not shown) formed by the interior of the C-shaped slot toward the forward ends of the spring strip 70. Such tabs are then inserted into the holes of the lower horizontal portion 52 and in the jaw member 40 to mechanically hold the spring strip to the jaw member and the frame member. The tabs serve as means to resist the withdrawal of the gripping pads or the spring strip from the trolley, either because of the bias force from the spring strip or because of the forces created by removing hanger ends from the trolley.

The biasing force from the spring strip 70 tends to pivot the jaw member 40 counterclockwise about the pin 44 away from the lower horizontal leg portion 52 and the lower gripping pad 62, as shown in FIG. 4. Of course, the locking lever 46 must be pivoted counterclockwise to an unlocked position, as is also shown in FIG. 4, in order to allow the jaw member 40 to pivot to an open position. The upper gripping pad 60 moves in unison with the jaw member 40 because of a resilient compressed fit within the U-shaped channel and the effects of the upper projection 76 (FIG. 3).

Locking and unlocking the trolley 10 is conveniently accomplished with single handed manipulation. The user simply grasps the grasping portion 50 of the locking lever 46 and lifts upward. The lower grasping portion 50 of the locking lever extends below the lower horizontal portion 52 of the frame member so it is accessible for lifting by a finger. The locking edge 54 slides inward along the locking shoulder 56 (FIG. 2) and releases the locked connection. The spring strip 70 thereafter lifts the clamping jaw member 40 and exposes a space between the gripping pads 60 and 62 for the user to insert or remove the hook shaped ends of hangers (FIG. 4). As the clamping jaw member 40 pivots counterclockwise as shown in FIG. 4, the upper curved surface 53 of the locking lever 46 slides along the interior surface of the upper horizontal portion 34 until the locking lever 46 has pivoted sufficiently counterclockwise to separate the surface 53 from the interior surface of the upper horizontal portion 34. The locking lever thereby pivots to a generally forward extending position as shown in FIG. 4 and exposes the opening between the separated gripping pads 60 and 62 for unobstructed movement of the hooked ends of the hangers.

To close the trolley 10 and thereby lock the hangers in place, as shown in FIG. 5, the user pivots the locking lever 46 in a clockwise direction. This pivoting action is conveniently achieved by pressing with the thumb on the forward surface of the finger gripping portion 50. As the locking lever pivots clockwise, the rounded surface portion 53 of the upper end of the locking lever 46 acts as a cam surface and slides along the interior surface of the upper horizontal portion 34 of the C-shaped frame 30. The curved surface 53 creates a camming effect which moves the jaw member 40 toward the lower horizontal portion 52 of the frame member, thus deforming the gripping pads 60 and 62 around the hanger ends 88 and 90. As the locking lever 46 continues its clockwise pivoting movement, the locking edge 54 ultimately snaps over the locking shoulder 56 as shown in FIG. 3. Substantial greater clockwise pivoting movement is prevented because the finger gripping portion 50 comes into close adjacency or contact with the front edge of the lower horizontal portion 52.

The locking relationship is maintained by the locking lever due to the upward force on the locking lever 46 which prevents the locking edge 54 from sliding below the locking shoulder 56. The upward force on the locking lever 46 results from the force of the compressed resilient gripping pads 60 and 62 and the effects of the spring strip 70. The amount of upward force on the locking lever 46 is sufficient to prevent accidental disconnection of this locking relationship, thus securely holding the hangers on the trolley 10. However, when manual force is applied to the locking lever 46, the gripping pads 60 and 62 will compress sufficiently to allow the locking edge 54 to pass below the locking shoulder 56. Other locking lever arrangements which close the opening at the front location of the frame member, and thereby prevent access to the opening, are within the scope of the invention.

The resilient compressible characteristics of the gripping pads 60 and 62 allow hook-shaped hanger ends of a variety of different sizes and configurations to be securely gripped, as shown in FIG. 5. The resilient material of the gripping pads compresses and deforms around the different sizes and shapes of hangers. Accordingly, the conventional wire hangers 88 or the newer thicker plastic hangers 90 can both be readily accomodated by the trolley 10.

The C-shaped frame member 30, the jaw member 40 and the locking lever 46 are preferably formed of polycarbonate plastic. Of course, the pins 44 and 48 and the spring strip 70 are formed of metal. The polycarbonate plastic has excellent characteristics for inhibiting breakage from impacts and other forces. The polycarbonate material can be molded for ease of construction and will present an attractive exterior appearance.

To prevent the hanger ends from moving or sliding off of the trolley, when it is either in its locked or unlocked position, a lip structure 100 is located adjacent the forward end of the lower gripping pad 62, as is shown in FIGS. 2 and 4. The lip 100 extends upward above an upper continuous edge or horizontal surface 102 of the lower gripping pad 62. The lip 100 thereby serves as a means operative at the forward end of the two opposed gripping pads 60 and 62 for preventing the withdrawal of the hanger ends. In the closed position of the trolley as is illustrated in FIG. 5, a curved surface 104 of the forward end of the upper gripping pad 60 contacts or adjoins a rearward facing curved surface 106 of the lip 100 to present an obstructed pathway through which hanger ends would have to move when the trolley is in the locked position in order for the hangers to fall off of hte trolley.

A rivet 108 extends through the lower gripping pad 62 and through appropriate holes formed in the upward extending side portions of the U-shaped channel of the lower horizontal leg portion 52 of the frame 30. The rivet 108 also serves as means for connecting the gripping pads to the frame member and for withdrawal of the gripping pads from the trolley, due to, for example, forces created during vibration of the trolley during transportation of the garment bag.

To increase the compressibility of the resilient flexible material from which the gripping pads 60 and 62 are formed, a plurality of holes 110, 112 and 114 can be formed transversely through the gripping pads 60 and 62. The holes 110, 112 and 114 provide voids or spaces into which the resilient material of the pads 60 and 62 can deflect when conformed around the hanger ends 88 and 90 as is shown in FIG. 5. The holes 110, 112 and 114 can assume a variety of different shapes, depending upon the degree of compressibility to be obtained, and other results to be obtained. As is shown in FIG. 2, the holes 114 are provided in the lower gripping pad 62 to obtain greater compressibility over that which would be obtained by a single group of holes 112.

The holes are preferably arranged in longitudinally spaced relationships with the holes 110 forming a row in the pad 60 inwardly spaced from a continuous edge or surface 113 as shown in FIG. 4. The edges 102 and 113 of pads 62 and 60, respectively, contact the hanger ends. The holes 110 and 112 are thus on opposite sides of their associated edges 113 and 102 than the oppositely facing pads 62 and 60, respectively.

One particularly advantageous result which can be obtained as a result of the shape of the holes 110 and 112 and the effects of the remaining resilient flexible material surrounding the holes is that a resistance to the removal of the hanger ends from between the gripping pads can be created which is greater when the hanger ends are moved toward the front location of the trolley than when the hanger ends are rearwardly moved into the trolley from the front location. Thus, it becomes easier for the user to insert the hanger ends between the gripping pads than it is to remove the hanger ends from between the gripping pads when the gripping pads both contact and retain the hanger ends. This is advantageous in that the resistance inhibits the unintentional withdrawal or movement of the hanger ends out of the trolley when the garment bag or other luggage piece is in use during traveling.

The particular arrangement employed in the present invention for creating a resistance to the removal of the hanger ends from between the gripping structures which is greater when moving the hanger ends toward the front location than when moving the hanger ends into the opening away from the front location is that the holes 110 and 112 are in the shape of parallelograms which leave ribs 116 between the holes 112 and ribs 118 between the holes 112. The ribs 116 and 118 both converge toward one another and to the rear of the opening between the gripping pads 60 and 62. As is shown in FIG. 5, the ribs 116 and 118 create a pawl-like resistance effect or detent-like resistance effect which tends to compress the ribs and create a greater resistance against movement of the hanger ends toward the front of the opening between the gripping pads. However, when the hangers are moved toward the rear of the opening between the gripping pads, the ribs 116 and 118 readily deflect downwardly and do not exhibit as much resistance as when the hanger ends move toward the front of the trolley.

The nature and operation of the present invention has been shown and described with a degree of specificity. It should be understood, however, that the specificity of the description has been made by way of preferred example and that the invention is defined by the scope of the appended claims.

What is claimed is:

1. In a trolley for suspending and retaining the hooked ends of clothes hangers in a luggage piece, comprising a substantially rigid frame member which defines an opening extending into the frame member from a front location thereof, a gripping structure, said gripping structure being formed of resilient and flexible material and having an edge extending therealong which contacts the hanger ends, means for operatively connecting the gripping structure to the frame member within the opening in an opposing facing relationship and between which the hooked ends of hangers are inserted and removed from the front location, and an improvement in combination therewith comprising:

means structurally integral with and interior of the edge of the gripping structure for creating a resistance to the removal of the hanger ends from the gripping structure, which resistance is created from the resiliency of the gripping structure and is greater upon movement of the hanger ends toward the front location than upon movement of the hanger ends rearwardly away from the front location.

2. An invention as defined in claim 1 wherein said gripping structure is made of a resilient and flexible material and has an edge extending therealong which contacts the hanger ends, and includes a plurality of ribs of resilient flexible material, said ribs extending internally from said edge with the ribs creating the resistance.

3. An invention as defined in claim 2 wherein the ribs are angled to extend toward the edge and rearwardly away from the front location of the opening.

4. An invention as defined in claim 3 wherein the edge is continuous and the gripping structure further includes a plurality of holes formed transversely into the gripping structure, the holes defining and separating the ribs, the ribs being integrally connected with the edge.

* * * * *